US008132787B1

(12) United States Patent
Audet

(10) Patent No.: US 8,132,787 B1
(45) Date of Patent: Mar. 13, 2012

(54) CONICAL JACK STANDS

(76) Inventor: Robert Douglas Audet, Alexandria, VA (US)

( * ) Notice: Subject to any disclaimer, the term of this patent is extended or adjusted under 35 U.S.C. 154(b) by 400 days.

(21) Appl. No.: 12/416,918

(22) Filed: Apr. 1, 2009

Related U.S. Application Data

(60) Provisional application No. 61/064,943, filed on Apr. 4, 2008.

(51) Int. Cl.
*B66F 3/08* (2006.01)

(52) U.S. Cl. ..... 254/98; 254/2 B; 254/7 B

(58) Field of Classification Search ..... 254/98, 254/100, 119, 102, 104, 7 B, 7 R, 2 B, 20
See application file for complete search history.

(56) References Cited

U.S. PATENT DOCUMENTS

| | | | | |
|---|---|---|---|---|
| 1,514,262 | A * | 11/1924 | Santmyer | 254/98 |
| 2,736,531 | A * | 2/1956 | Wilson | 254/93 H |
| 3,329,402 | A * | 7/1967 | Grumman | 254/420 |
| 3,399,866 | A * | 9/1968 | Grumman | 254/101 |
| 4,000,880 | A * | 1/1977 | Graafsma | 254/103 |
| 4,042,202 | A | 8/1977 | Molinari | |
| 4,141,526 | A | 2/1979 | John | |
| 4,245,808 | A | 1/1981 | John | |
| D269,473 | S | 6/1983 | Jönsson | |
| 4,404,780 | A | 9/1983 | Josephson | |
| 4,540,147 | A | 9/1985 | Lincourt | |
| 4,690,361 | A | 9/1987 | Lundman | |
| 5,002,256 | A | 3/1991 | Bedford | |
| 5,165,665 | A | 11/1992 | Jolivette, Sr. | |
| 5,180,131 | A | 1/1993 | Few | |
| D345,844 | S | 4/1994 | Steele | |
| 5,664,762 | A | 9/1997 | Rothbauer | |
| D394,199 | S | 5/1998 | Hodges | |
| D396,926 | S | 8/1998 | Underhill et al. | |
| 5,915,672 | A | 6/1999 | Dickey | |
| D456,975 | S | 5/2002 | Ji | |
| 6,443,413 | B1 | 9/2002 | Hawkins et al. | |
| D467,699 | S | 12/2002 | King | |
| 6,644,615 | B1 | 11/2003 | Liu | |
| D513,819 | S | 1/2006 | Ji | |
| 7,147,211 | B2 | 12/2006 | Porter | |
| 7,207,548 | B1 | 4/2007 | Howe | |
| 2011/0062399 | A1 * | 3/2011 | Kooima et al. | 254/92 |

FOREIGN PATENT DOCUMENTS

| | | |
|---|---|---|
| JP | 7-196290 | 8/1995 |

* cited by examiner

*Primary Examiner* — Lee D Wilson
(74) *Attorney, Agent, or Firm* — Swift & Swift, PLLC; Stephen Christopher Swift

(57) ABSTRACT

Conical jack stands that are used to hold up a motor vehicle (or other object) after it has been raised (e.g., by jacks). Rather than having legs like conventional jack stands, they have the shape of a hollow cone, with a circular bottom edge. The circular bottom edge gives them a larger bottom surface area than the bottom ends of the legs of conventional jack stands, so that they will be less likely to sink into the ground or asphalt. There is a hole with internal screw threads in the top of each cone, into which a large bolt-like contacting member is screwed. The contacting members can be rotated to adjust the height of the jack stands. Their hollow conical shape makes it easy to stack the jack stands for storage. Four jack stands are stored in a square box, with one contacting member in each corner of the box.

20 Claims, 8 Drawing Sheets

CONICAL JACK STANDS

CROSS REFERENCE TO RELATED APPLICATION

This application is based on and claims the benefit of Provisional Patent Application Ser. No. 61/064,943, filed Apr. 4, 2008, which is incorporated herein by reference.

BACKGROUND OF THE INVENTION

1. Field of the Invention

The present invention relates to jack stands for holding up automobiles or other large objects, after they have been raised by jacks.

2. Description of the Prior Art

There have been numerous previous inventions of devices for holding up large objects, but none that are equivalent to the present invention.

U.S. Pat. No. 4,042,202, issued on Aug. 16, 1977, to Delmo C. Molinari, discloses a jack stand having metal straps between its legs to give it greater stability, and a pad at the top with a flattened center and sloping edges. The conical shape and circular bottom of the instant invention are clearly distinguishable.

U.S. Pat. No. 4,141,526, issued on Feb. 27, 1979, to Julius F. John, and U.S. Pat. No. 4,245,808, issued on Jan. 20, 1981, to Julius F. John, disclose a jack stand having interlocking metal sheets that form tapering legs with flanges that can rest on the ground. While this increases the surface area in contact with the ground, the conical shape and circular bottom of the instant invention are clearly distinguishable.

U.S. Pat. No. 4,404,780, issued on Sep. 20, 1983, to Martin Josephson, discloses a support system for restraining lateral movement of a pier-mounted building, having a pyramidal pier with a vertical jack screw somewhat resembling the conical jack stand of the instant invention, but not round and not hollow.

U.S. Pat. No. 4,540,147, issued on Sep. 10, 1985, to William R. Lincourt, discloses a jack stand attachment having a V-shaped rest.

U.S. Pat. No. 4,690,361, issued on Sep. 1, 1987, to Philip L. Lundman, discloses a jack stand having a cylindrical body, rather than a conical body as in the instant invention.

U.S. Pat. No. 5,002,256, issued on Mar. 26, 1991, to Marlin D. Bedford, discloses a device for lifting and supporting a wheeled vehicle, having conical support members. It does not disclose that the conical support members are hollow or stackable, as in the instant invention.

U.S. Pat. No. 5,165,665, issued on Nov. 24, 1992, to Wilbert L. Jolivette, Sr., discloses an adjustable collapsible jack mechanism, with a V-shaped top.

U.S. Pat. No. 5,180,131, issued on Jan. 19, 1993, to Jeffrey P. Few, discloses a spring loaded jack stand.

U.S. Pat. No. 5,664,762, issued on Sep. 9, 1997, to Thomas D. Rothbauer, discloses an automotive screw jack, in which the top is raised by a screw in the side of the base.

U.S. Pat. No. 5,915,672, issued on Jun. 29, 1999, to Leslie A. Dickey, discloses a collapsible jack stand, with legs that can be connected to a flat base plate.

U.S. Pat. No. 6,443,413, issued on Sep. 3, 2002, to Joseph O. Hawkins, John H. Blackburn and Fred Schliesseit, discloses an adjustable jack stand, that is raised and lowered by a ratchet, rather than by screw threads as in the instant invention.

U.S. Pat. No. 6,644,615, issued on Nov. 11, 2003, to James Liu, discloses a stabilized jack stand, with legs that are removably attached to a square foot plate.

U.S. Pat. No. 7,147,211, issued on Dec. 12, 2006, to Rodney Porter, discloses a hydraulic jack stand, with conical legs.

U.S. Pat. No. 7,207,548, issued on Apr. 24, 2007, to Richard L. Howe, discloses an automobile jack stand with lights, having sloping, pyramidal sides.

U.S. Pat. No. Des. 269,473, issued on Jun. 21, 1983, to Leif Jönsson, discloses a design for a collapsible jack for automobiles and the like.

U.S. Pat. No. Des. 345,844, issued on Apr. 5, 1994, to Earlie Steele, discloses a design for an air operated vehicle lifting jack, part of which is conical.

U.S. Pat. No. Des. 394,199, issued on May 12, 1998, to Douglas Hodges, discloses a design for a transmission support stand, with sloping sides and a square base.

U.S. Pat. No. Des. 396,926, issued on Aug. 11, 1998, to Victor H. Underhill and Allison Gordon, discloses a design for a jack stand, with a cylindrical body and a top member that appears to be raised and lowered by screw threads.

U.S. Pat. No. D456,975, issued on May 7, 2002, to Jun Ji, discloses a design for a jack stand with wide legs and a top member with sloping sides.

U.S. Pat. No. D467,699, issued on Dec. 24, 2002, to Isaac King, discloses a design for a jack stand with a broad, square base, and a top member with sloping sides.

U.S. Pat. No. D513,819, issued on Jan. 24, 2006, to Jun Ji, discloses a design for a jack stand with a cylindrical main body and a solid circular bottom.

Japanese Patent No. 7-196290, published on Aug. 1, 1995, inventor Tatsuji Amano, discloses a screw jack, that appears to be raised and lowered by turning a gear in its side.

None of the above inventions and patents, taken either singly or in combination, is seen to describe the instant invention as claimed.

SUMMARY OF THE INVENTION

The present invention is of new and improved jack stands that are used to hold up a motor vehicle after it has been raised by jacks. Rather than having legs like conventional jack stands, they have the shape of a hollow cone, with a circular bottom edge. The circular bottom edge gives them a larger bottom surface area than the bottom ends of the legs of conventional jack stands, so that they will be less likely to sink into the ground or asphalt. There is a hole with internal screw threads in the top of each cone, into which a large bolt-like contacting member is screwed. The contacting members each have a V-shaped slot in their top surface for retaining a jacking point of the vehicle. The contacting members can be rotated to adjust the height of the jack stand. Their hollow conical shape makes it easy to stack the jack stands for storage. Normally, four jack stands will be stored in a square box, with one contacting member in each corner of the box.

Accordingly, it is a principal object of the invention to provide jack stands that are less likely to sink into a surface.

It is another object of the invention to provide jack stands with an adjustable height.

It is a further object of the invention to provide jack stands that may be stacked.

Still another object of the invention is to provide a convenient means for storing jack stands.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is cone-shaped jack stands that may be easily stacked for storage.

Figure 1:
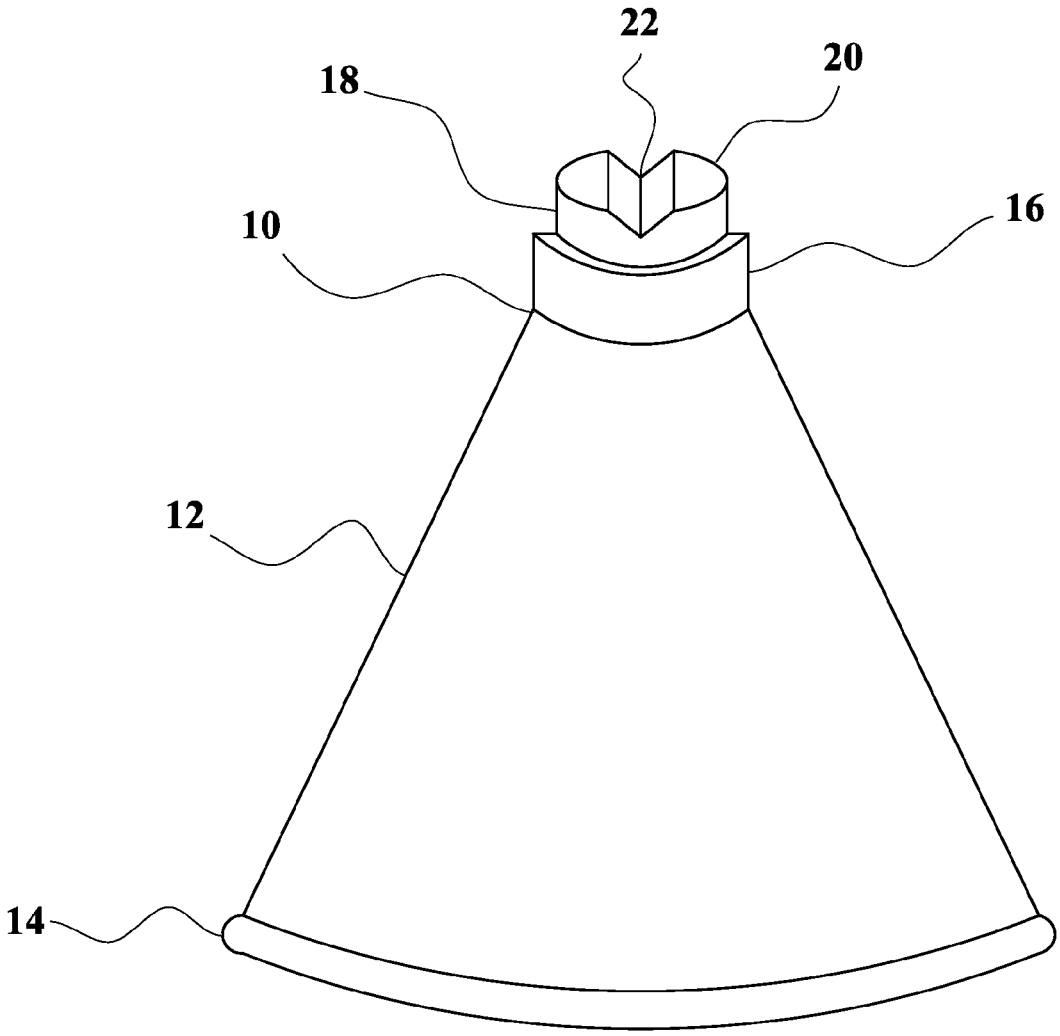
FIG. 1 is a perspective view of the preferred embodiment of the invention.

FIG. 1 is a perspective view of the preferred embodiment of the invention, showing the jack stand 10, the hollow, cone-shaped main body 12, its circular bottom edge 14, its cylindrical top part 16, and the connecting member 18 having a head 20 with a V-shaped groove 22 that is suitably dimensioned and configured to retain a jacking point of an automobile. Alternatively, the head of the connecting member may have a groove that is saddle-shaped or has any shape that is suitable for the object that is being jacked up. The main body is preferably made from aluminum or polyvinylchloride ("PVC") plastic, but any suitable material may be used.

Figure 2:
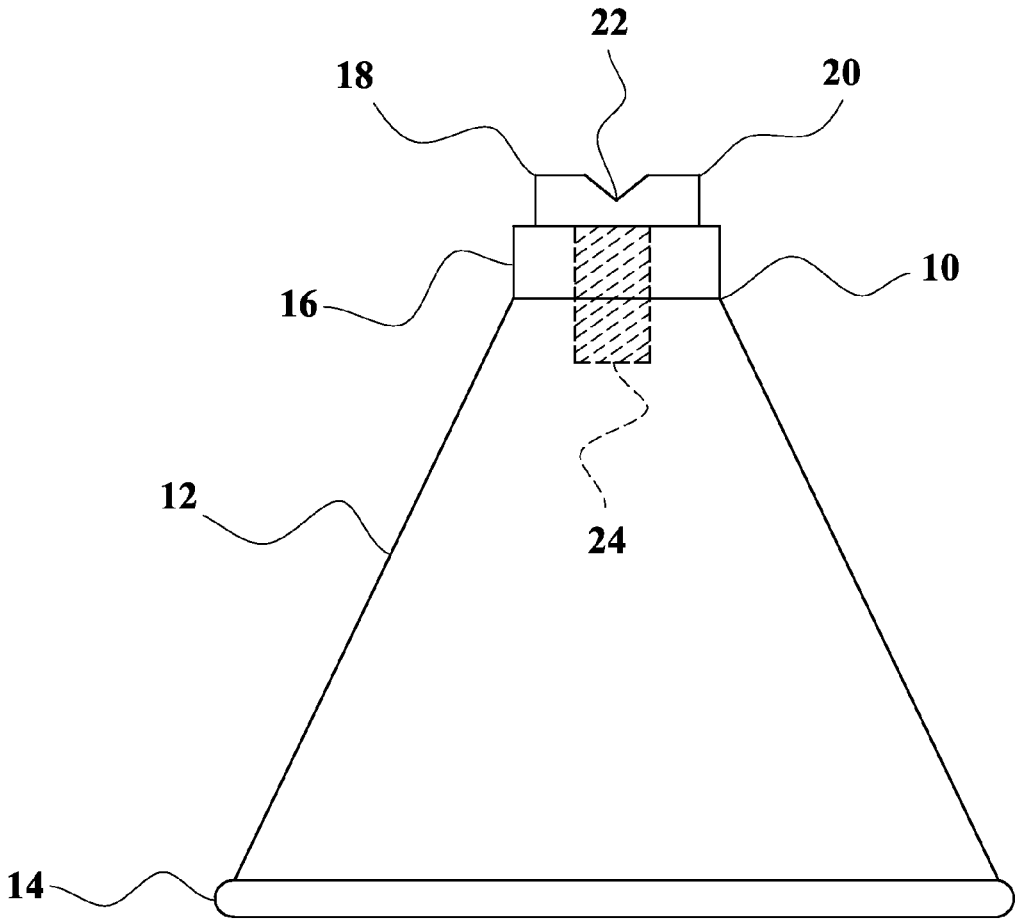
FIG. 2 is a front elevational view of the preferred embodiment of the invention, showing the contacting member in a lowered position.
Figure 3:
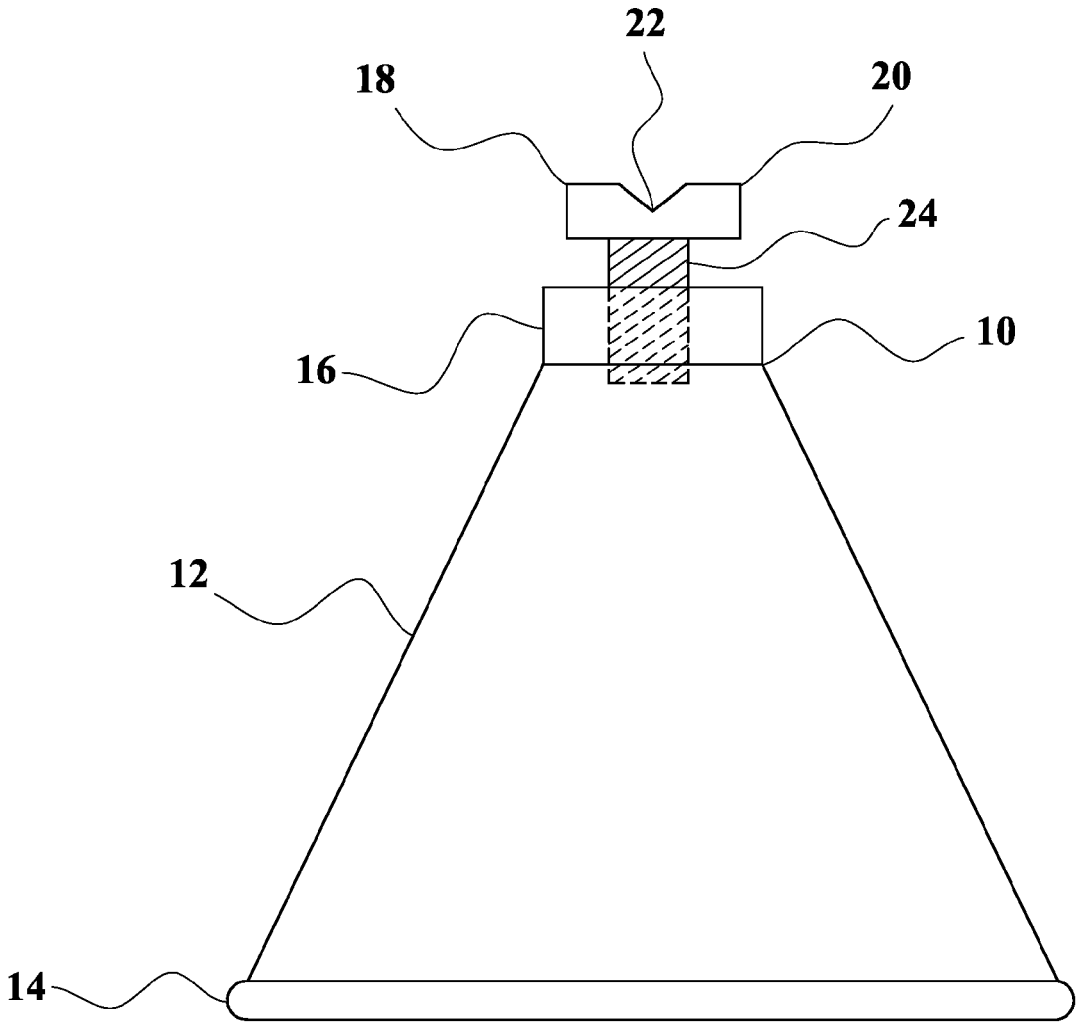
FIG. 3 is a front elevational view of the preferred embodiment of the invention, showing the contacting member in a raised position.
Figure 4:
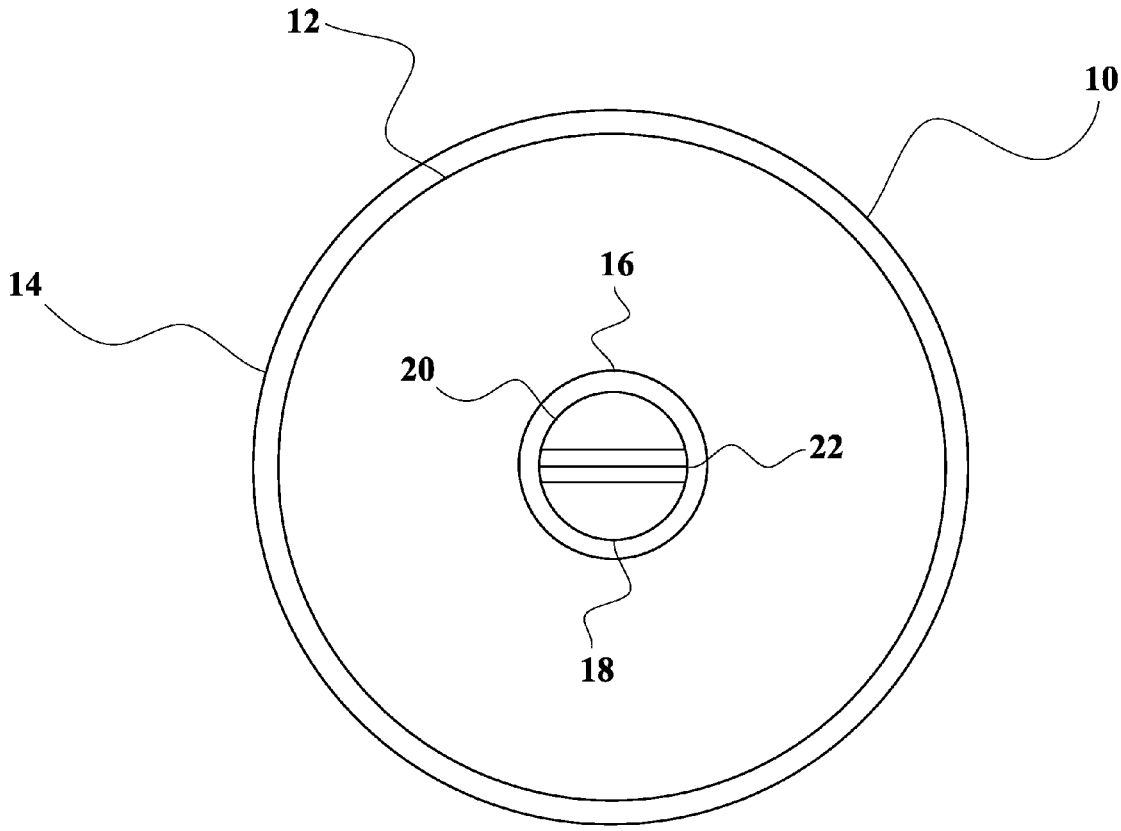
FIG. 4 is a top view of the preferred embodiment of the invention.

FIG. 2 is a front elevational view of the preferred embodiment of the invention, showing the contacting member 18 in a lowered position. The externally screw-threaded shaft 24 of the contacting member would not be externally visible, but it is shown in broken lines. The external screw threads of the shaft of the contacting member engage internal screw threads in a hole in the center of the top part 16 of the main body. FIG. 3 is a front elevational view of the preferred embodiment of the invention, showing the contacting member 18 in a raised position. The contacting member is rotated to raise or lower it to the desired height. FIG. 4 is a top view of the preferred embodiment of the invention.

Figure 5:
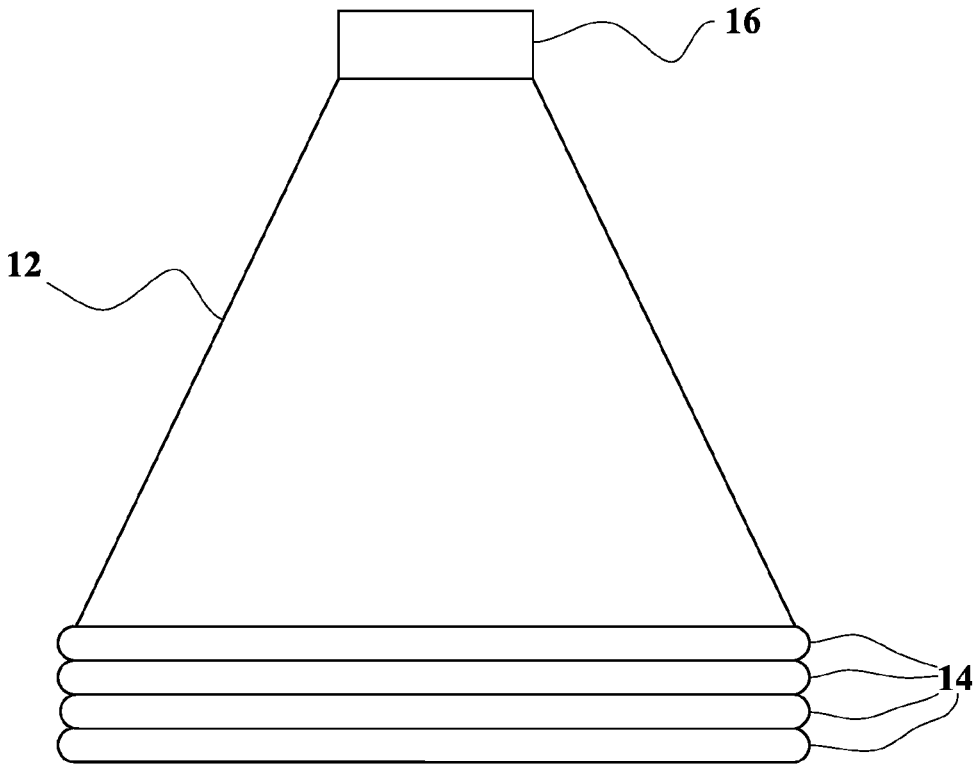
FIG. 5 is a front elevational view of four of the main bodies of the conical jack stands of the preferred embodiment of the invention, showing the main bodies stacked, with the contacting members removed.
Figure 6:
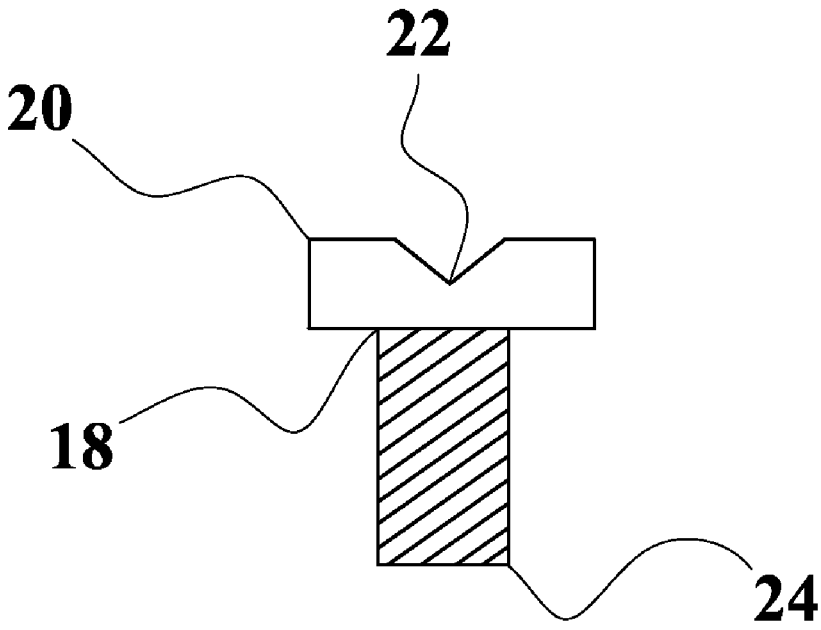
FIG. 6 is a front elevational view of the contacting member of the preferred embodiment of the invention.

FIG. 5 is a front elevational view of four of the main bodies of the conical jack stands of the preferred embodiment of the invention, showing the main bodies stacked, with the contacting members removed. FIG. 6 is a front elevational view of the contacting member of the preferred embodiment of the invention.

Figure 7:
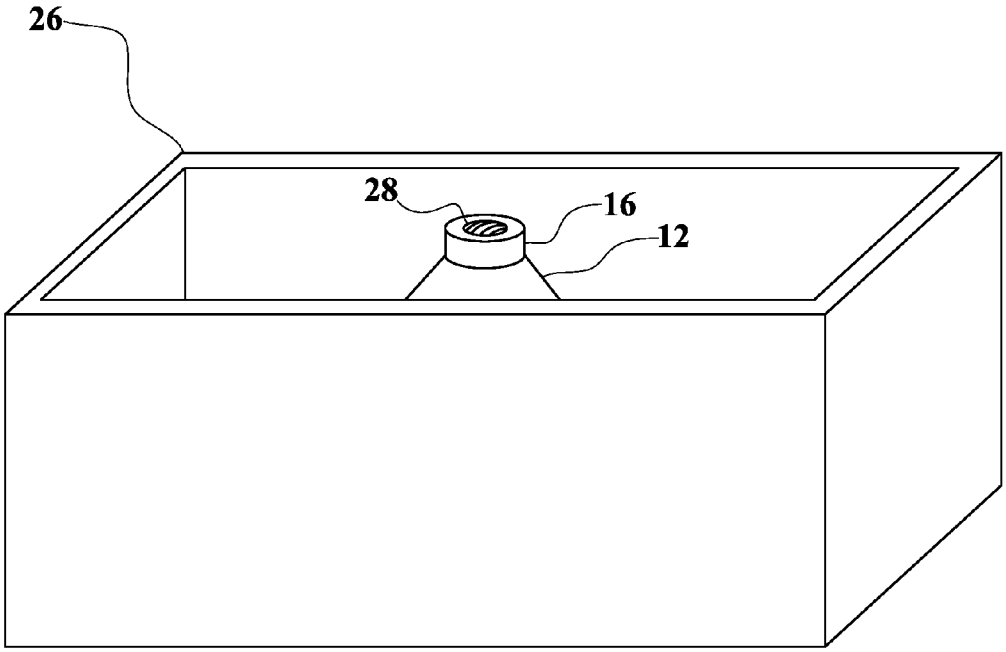
FIG. 7 is a perspective view of the storage box of the preferred embodiment of the invention.
Figure 8:
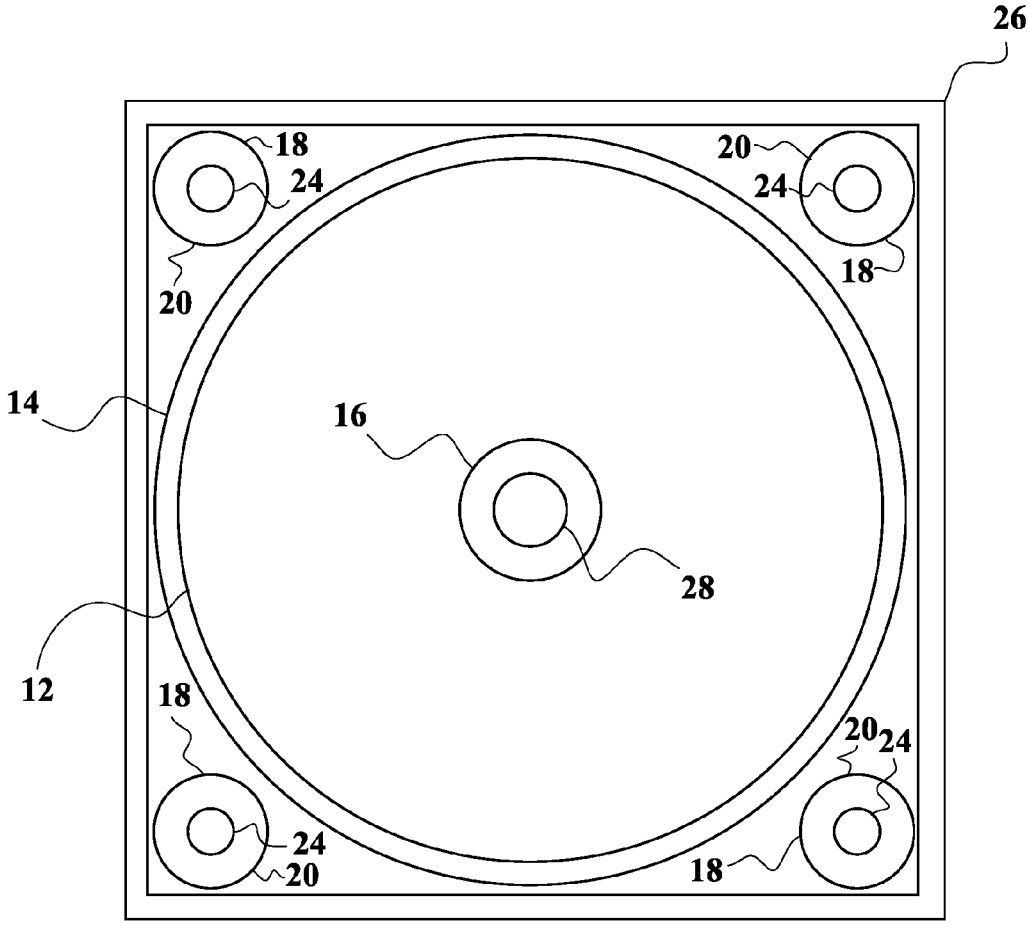
FIG. 8 is a top view of the storage box of the preferred embodiment of the invention.

FIG. 7 is a perspective view of the storage box 26 of the preferred embodiment of the invention, with four stacked conical main bodies 12 (only the top one is visible in this drawing) and four separated contacting members (which are not visible in this drawing). The internally threaded hole 28 in the center of the top part 16 of the main body is visible in this drawing. FIG. 8 is a top view of the storage box of the preferred embodiment of the invention, with the four stacked conical main bodies in the center, and the four contacting members (shown in an upside down position) in each corner of the box.

It is to be understood that the present invention is not limited to the sole embodiment described above, but encompasses any and all embodiments within the scope of the following claims.

I claim:

1. A conical jack stand, comprising:

a hollow main body having a conical shape with a circular bottom edge, and a part having a hole with internal screw threads at the top of the main body, said hollow main body having no other parts; and a threaded contacting member that can be screwed into the hole at the top of the main body, with the contacting member having a cylindrical head and a cylindrical shaft with external screw threads that engage the internal screw threads in the hole at the top of the main body, said contacting member having no other parts, and being readily removable from the hollow main body.

2. The conical jack stand according to claim 1, wherein the main body is made of aluminum.

3. The conical jack stand according to claim 1, wherein the main body is made of polyvinylchloride.

4. A combination of conical jack stands and a box, comprising:

jack stands, each having a hollow main body having a conical shape with a circular bottom edge, and a part having a hole with internal screw threads at the top of the main body, with each main body having external and internal surfaces so configured that a plurality of main bodies can be stacked in a stable column, said main bodies having no other parts;

a threaded contacting members that can be screwed into the holes at the tops of the main bodies of the jack stands, with the contacting members each having a cylindrical head and a cylindrical shaft with external screw threads that engage the internal screw threads in the hole at the top of the main bodies~said contacting members having no other parts, and being readily removable from the hollow main body; and a square box, suitably dimensioned and configured that the main bodies of the jack stands may be stacked in the center of the box, with the contacting members in corners of the box.

5. The conical jack stand according to claim 1, wherein there is a groove in a top surface of the head of the contacting member, suitably dimensioned and configured to retain a jacking point of a vehicle.

6. The conical jack stand according to claim 5, wherein the groove in the top surface of the head of the contacting member is a V-shaped slot.

7. The conical jack stand according to claim 5, wherein the contacting member can be raised and lowered by rotating the contacting member, when the shaft of the contacting member is in the hole at the top of the main body.

8. The conical jack stand according to claim 5, wherein the main body has external and internal surfaces so configured that a plurality of main bodies can be stacked in a stable column.

9. The combination of conical jack stands and a box according to claim 4, wherein:

the box is square;

there are four jack stands;

there are four contacting members; and when the jack stands are stacked in the center of the box, one of the contacting members will fit in each of the four corners of the box.

10. The combination of conical jack stands and a box according to claim 9, wherein:

there is a groove in a top surface of the head of each of the contacting members, suitably dimensioned and configured to retain a jacking point of a vehicle.

11. The combination of conical jack stands and a box according to claim 10, wherein the groove in the top surface of the head of the contacting member is a V-shaped slot.

12. The conical jack stand according to claim 11, wherein each of the contacting members can be raised and lowered by rotating the contacting member, when the shaft of the contacting member is in the hole at the top of one of the main bodies.

13. The conical jack stand according to claim 12, wherein the main body is made of aluminum.

14. The conical jack stand according to claim 12, wherein the main body is made of polyvinylchloride.

15. A method of holding up a heavy object, comprising the steps of:

raising the object;

placing one or more jack stands under the object, with each of the jack stands having a hollow main body with a conical shape and a circular bottom edge, a part having a hole with internal screw threads at the top of the main body, said hollow main body having no other parts, and a threaded contacting member screwed into the hole at the top of the main body, with the contacting member having a cylindrical head and a cylindrical shaft with external screw threads that engage the internal screw threads in the hole at the top of the main body, said contacting member having no other parts, and being readily removable from the hollow main body; and rotating the contacting member in a direction that causes its shaft to rise in the hole at the top of the main body, until a top surface of the head of the contacting member touches a bottom surface of the object.

16. The method of holding up a heavy object according to claim 15, wherein the heavy object is a motor vehicle.

17. The method of holding up a heavy object according to claim 16, wherein there is a groove in the top surface of the head of each of the contacting members, suitably dimensioned and configured to retain a jacking point of the motor vehicle.

18. The method of holding up a heavy object according to claim 17, wherein the groove in the top surface of the head of each of the contacting members is a V-shaped slot.

19. The method of holding up a heavy object according to claim 18, wherein each of the main bodies has external and internal surfaces so configured that a plurality of the main bodies can be stacked in a stable column.

20. The method of holding up a heavy object according to claim 19, wherein, when they are not in use, the jack stands are stored in a box, suitably dimensioned and configured that the main bodies of the jack stands may be stacked in the center of the box, with the contacting members in corners of the box.

* * * * *